United States Patent [19]

Drummond

[11] 3,955,952

[45] May 11, 1976

[54] METHOD OF MAKING A SLUBBY STRAND

[75] Inventor: Warren W. Drummond, Allison Park, Pa.

[73] Assignee: PPG Industries, Inc., Pittsburgh, Pa.

[22] Filed: Jan. 31, 1975

[21] Appl. No.: 545,940

Related U.S. Application Data

[63] Continuation-in-part of Ser. No. 452,105, March 18, 1974.

[52] U.S. Cl. ..... 65/3 C; 28/72.11; 57/140 G; 57/162; 65/4 A; 65/11 W; 156/158; 156/431; 427/174

[51] Int. Cl.[2] ..... C03B 37/02

[58] Field of Search ..... 65/3 C, 4 A; 28/72 FT, 28/72, 11; 57/160, 162, 140 G, 7, 77.4; 156/158, 183, 431, 441; 427/174, 180

[56] References Cited

UNITED STATES PATENTS

| | | | |
|---|---|---|---|
| 2,939,761 | 6/1960 | Stein | 65/4 A X |
| 3,410,077 | 11/1968 | Marzocchi et al. | 28/72.12 |
| 3,495,393 | 2/1970 | Wada et al. | 65/3 C X |
| 3,685,268 | 8/1972 | Seguin | 57/160 |

*Primary Examiner*—Robert L. Lindsay, Jr.
*Attorney, Agent, or Firm*—John E. Curley

[57] ABSTRACT

A method of forming a slubby glass fiber strand is disclosed which involves passing a plurality of glass fibers as they are drawn from a bushing in parallel over a working surface at a first velocity and directing a second plurality of glass fibers drawn from the same bushing or an adjacent bushing at a second velocity higher than the first into the first plurality of glass fibers while they are passing over the working surface. Both of the groups of glass fibers are wet at the point of contact with each other and the subsequent entanglement of the fibers causes a substantial bulking of the yarn. Further, binder may be added as the bulked yarn is gathered into a single strand. The resulting strand is passed through a gathering shoe to allow strip back at the surface of the bulked yarn so that a plurality of slubs are produced on the surface of the yarn.

9 Claims, 3 Drawing Figures

METHOD OF MAKING A SLUBBY STRAND

CROSS-REFERENCE TO RELATED APPLICATIONS

This application is a continuation-in-part of co-pending application Ser. No. 452,105, filed Mar. 18, 1974.

BACKGROUND OF THE INVENTION

Novelty yarns are produced by a variety of processes in the textile and find utility for many specific textile purposes, for example, in the manufacture of draperies. Thus, many processes have been designed, especially in processing glass fiber yarns to produce decorative effects on glass fiber strands to render them useful in providing bulk for cloth to be woven for decorative purposes as well as for industrial purposes.

Thus, in U.S. Pat. No. 3,388,444 a process is described in which glass fiber strands are passed through a texturizing jet at various rates of speed and air pressure is introduced into the jet to entangle the yarns passing therethrough to produce a bulking effect on the yarn issuing from the jet. In another process bulky yarn is produced by providing core and effect yarns which travel at different speeds as they are passed through an air blowing device to filamentize the individual fibers of the faster traveling strand and entangle them with the core yarn.

THE INSTANT INVENTION

In accordance with the instant invention a method of providing a slubby strand during formation of fibers, and of glass fibers in particular, on a continuous basis and at high speed is provided. The slubs formed in accordance with the instant invention are readily obtainable on fast moving strands, i.e., strands moving at 5,000 to 10,000 feet (1524 to 3048 meters) per minute or more to produce strands which find a wide range of utility in the decorative textile field. Thus in accordance with the present invention a method of producing a slubby glass strand is provided which involves attenuating a first group of parallel glass fibers from a molten glass source (filaments or groups of filaments) and passing them at a first speed over a working surface. The fibers are wetted prior to passage over the working surface. A second group of parallel glass fibers drawn from a molten glass source (filaments or groups of filaments) is fed onto the said working surface at a second speed and in a direction generally transverse to the direction of travel of the first group of glass fibers. The second group is also wetted prior to contacting said working surface. The second group of glass fibers are fed at a speed in excess of the speed of the first group of fibers and the second speed is sufficiently high so that the second group of fibers upon striking the working surface become entangled upon themselves and with the first group of fibers causing an interlocking of the fibers of both groups and a subsequent bulking of the fibers. The second group of fibers as it strikes the working surface, in general, has a tendency to crimp by the action of the fibers bending upon themselves due to their inherent high inertial energy being released upon striking the surface. This crimping greatly assists in interlocking the fibers of both groups.

After the bulking operation, the fibers are then passed through a gathering device, such as a positive rotational gathering shoe to consolidate them into a strand. A binder may be applied to the fibers either while they are being brought together on the gathering shoe or just prior to their entry into the gathering shoe area if further wetting of the fibers is necessary. The fibers are normally collected on a rotating mandrel operating at a high speed, 5,000 to 10,000 feet (1524 to 3048 meters) per minute or more. The rotational movement of the gathering shoe is provided with sufficient drag so that the strands as they are passed through the gathering shoe have a portion of the strand stripped back due to frictional forces on the surface of the gathering shoe exerted on the strand surface as it is pulled rapidly by the winder on which the strand is being collected. The stripping back of a portion of the fibers on the surface of the strand forms an intermittent slub on the strand and thus a glass strand containing a plurality of intermittent slubs along the surface is readily formed.

The process of the instant invention is quite versatile in that the slubby strand can be produced from a single bushing which is conveniently divided mechanically to produce two ribbons of fibers or it can be produced from separate bushings located in close proximity to each other. In any event the strand is produced at high speed directly in forming and provides a considerable advantage over the utilization of the conventional twist frame techniques currently practiced in the prior art.

For a more complete understanding of the present invention reference is made to the accompanying drawings in which.

Figure 1:
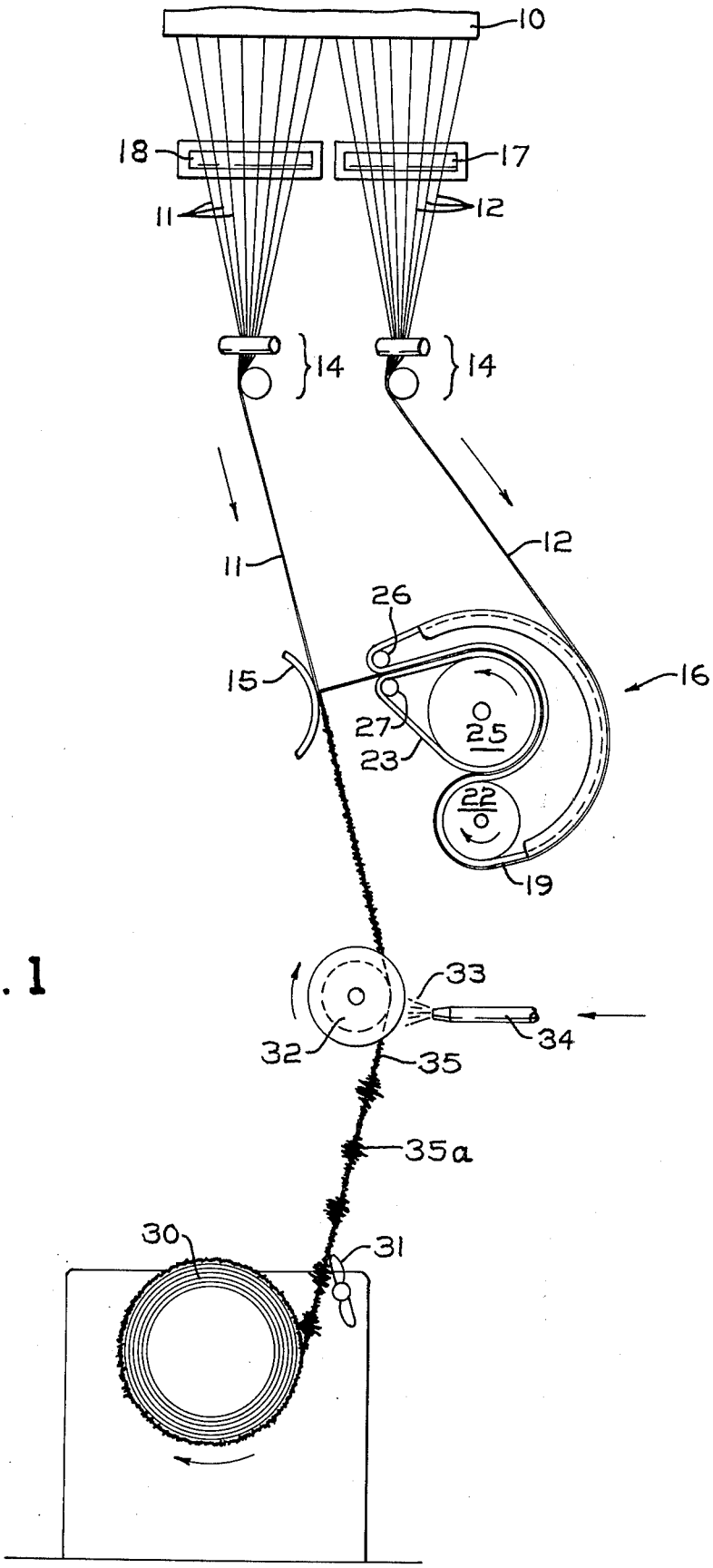
FIG. 1 represents one embodiment of the instant invention for creating the slubby strand.

Turning to the drawings, and in particular to FIG. 1, there is shown a fiber glass forming bushing 10. The filaments issuing from the underside of the bushing 10 pass over the applicators 18 and 17 and by consolidation caused presumably by surface tension of the aqueous size or binder solution used form two fan-shaped groups of glass fibers 11 and 12, respectively. The glass fiber fans 11 and 12 are formed typically from a plurality of glass filaments issuing from the bushing, 5 to 50 filaments per group being typical. The grouping of the filaments emanating from the bushing 10 is the result of several adjacent filaments coming together naturaly as they are drawn downwardly from the bushing 10 by attenuation forces and being wetted on the applicators 18 and 17. The groups of filaments or small strands forming the fan 11 are drawn over a ribboning device indicated generally as 14. This device maintains the strands in parallel, spaced relationship each to the other until they pass over the working surface 15. Similarly the groups of filaments or small strands 12 are passed over the ribboning device 14 which maintains the strands in parallel, spaced relationship, each to the other, until they are fed into the attenuating device 16.

The parallel strands 12 emanating from the strand ribboning means 14 are passed around the surface of the attenuator 16 on belt 19 which is rotating in a clockwise direction and is passed over idler pulley 22. The strands 12 as they pass over the rotational surface of the pulley 22 are engaged by a second belt 23 which is rotating in a counterclockwise direction driven by pulley member 25. Thus, the parallel strands 12 are held tightly between the belts 23 and 19 as the belts 23 and 19 rotate in the attenuator 16. The strands 12 are released from the two belt members 23 and 19 as those belts pass over pins 27 and 26, respectively, and are reflexed on these pins to continue their rotational movement in the attenuator 16. At this point of flexure the strands 12 are ejected in a straight line onto the working surface 15.

The strands 11, which have passed through the strand separator or ribboning means 14 emerge as a plurality of paralleled, spaced strands 11 which are connected to a winder 30 equipped with a suitable spiral 31 for laying strand across the package in a conventional manner. Interposed between the working surface 15 and the winder 30 is a gathering shoe 32 which rotates slowly in a clockwise direction. The strands 11 as they pass over the working surface 15 are thus intersected by the strands 12 being ejected from the belt attenuator 16 and a tremendous amount of entanglement occurs between the strands 11 and the strands 12. The thoroughly entangled and knotted strands 11 and 12 are then passed over the surface of the gathering shoe 32 where they are consolidated into a single strand 35. A binder 33 may be applied thereto from a spray device 34. The gathering shoe 32 is typically a grooved, wheel surface which has a considerably slower rotational movement than the winder 30 thus causing considerable drag on the strand as it passes over its surface on its way to the winder 30. This drag causes the strands on the surface of strand 35, which tend to be wound around and entangled thoroughly in core strands 11, but positioned more towards the surface thereof, to be stripped back as they pass over this wheel by the frictional force applied to produce a series of intermittent slubs on the consolidated strand 35. The integrity of the slubs is excellent because the degree of entanglement caused by projecting the wet strands 12 through the wet strands 11 on the working surface 15 results not only in considerable entanglement of the strands, but in considerable crimping of the strands 12 as they strike the surface 15. This crimping action is caused by the high inertial forces present in the parallel glass strands 12 as they are ejected at extremely high speeds from the exit point of the attenuator 16 and strike the hard surface of the working member 15 over which the strands 11 are passing.

Figure 2:
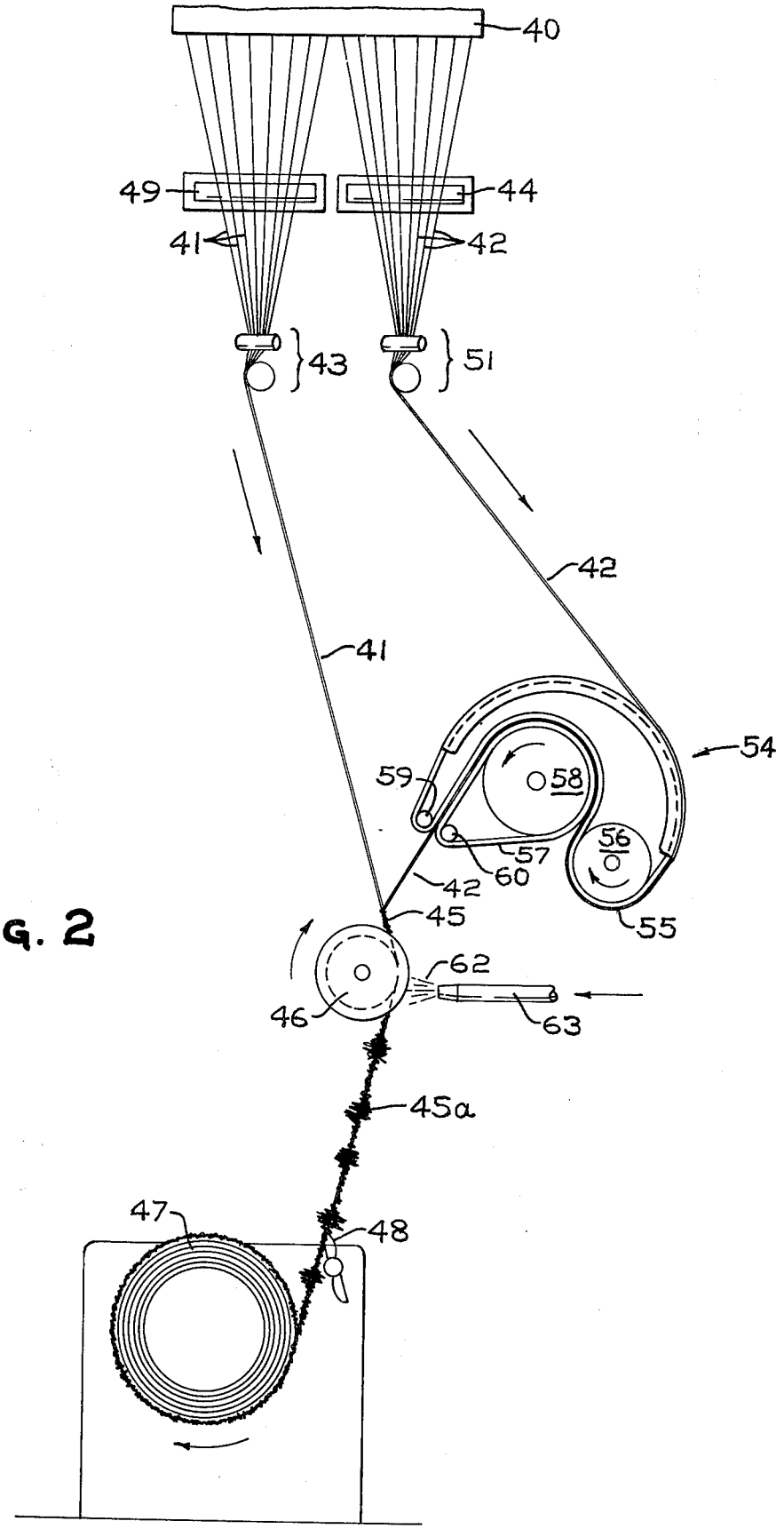
FIG. 2 represents a diagrammatic illustration of a second method of providing slubby strand in accordance with the instant invention.

Turning to FIG. 2 there is shown a second embodiment of the instant invention in which filaments are drawn from a bushing 40, passed over applicators 44 and 49 which apply an aqueous size or coating to the filaments and from which the filaments are grouped into two fans of glass strands 41 and 42 by the natural grouping of the filaments emanating from the bushing 40 respectively. Thus strands 41 and 42 typically contain 5 to 50 filaments per strand. The strands 41 are passed over strand separator or ribboning device 43 to maintain the multiple strands in parallel, spaced relationship one to the other. These strands 41 are passed downwardly and across the face of a gathering shoe 46 and are subsequently wound on a high speed winder 47 which is equipped with a spiral 48 utilized to lay the strand across the package being wound. The strands 42 are passed through strand separator 51 and are then passed across the face of an attenuator generally indicated at 54. Attenuator 54 is provided with a belt member 55 which moves around an idler pulley 56. The parallel strands 42 are passed onto the surface of the belt 55 and are trapped between that belt and a second belt 57 which is rotating counterclockwise driven by a pulley member 58. Thus the strands 42 are engaged by the belts 55 and 57 passing over the surfaces of the pulleys 56 and 58, respectively and are passed through the attenuator 54 by their engagement between these two belt members. The strands 42 are ejected from the attenuator 54 as belt 55 changes direction by flexure around the stationary pin member 59 and the belt 57 flexes around the stationary pin member 60. This flexing of the belts projects the strands 42 in a straight line in a direction designed to intersect with the path of travel of the strands 41 traveling downwardly to the gathering shoe 46.

At the point of intersection of the strands 42 and the strands 41 considerable entanglement of the strands occurs as the strands 42 traveling at higher speeds then the strands 41 strike the surface of those strands. The high inertial forces of the high speed traveling strands 42 cause considerable penetration through the parallel fibers 41 and entanglement therewith as the two strands intersect. This causes considerable bulking of the resulting yarn or consolidated strand 45 and the yarn 45 as it travels across the face of the gathering shoe 46 is sprayed with a binder 62 issuing from a suitable binder nozzle or spray device 63. The gathering shoe 46 is rotating in a clockwise direction at a rather slow speed of rotation in comparison to the rotational speed of the winder 47 which is supplying the attenuation forces to strands 41 and consequently considerable frictional forces are developed as the bulked yarn 45 resulting from the commingling of the parallel strands 41 and 42 pass through the gathering shoe 46. Gathering shoe 46 is typically a grooved wheel with the strands passing through the wheel in the groove. The drag on the gathering shoe 46 and the strands passing over the surface thereof cause considerable stripping back of the surface strands of the consolidated strand or yarn 45. The stripping back action caused by these frictional forces results in the production of intermittent slubs **45*a* along the strand 45 in its path of travel to the winder 47 and thus on the winder 47 a strand material 45 is wound which contains intermittent slubs 45*a*** along the surface thereof.

Figure 3:
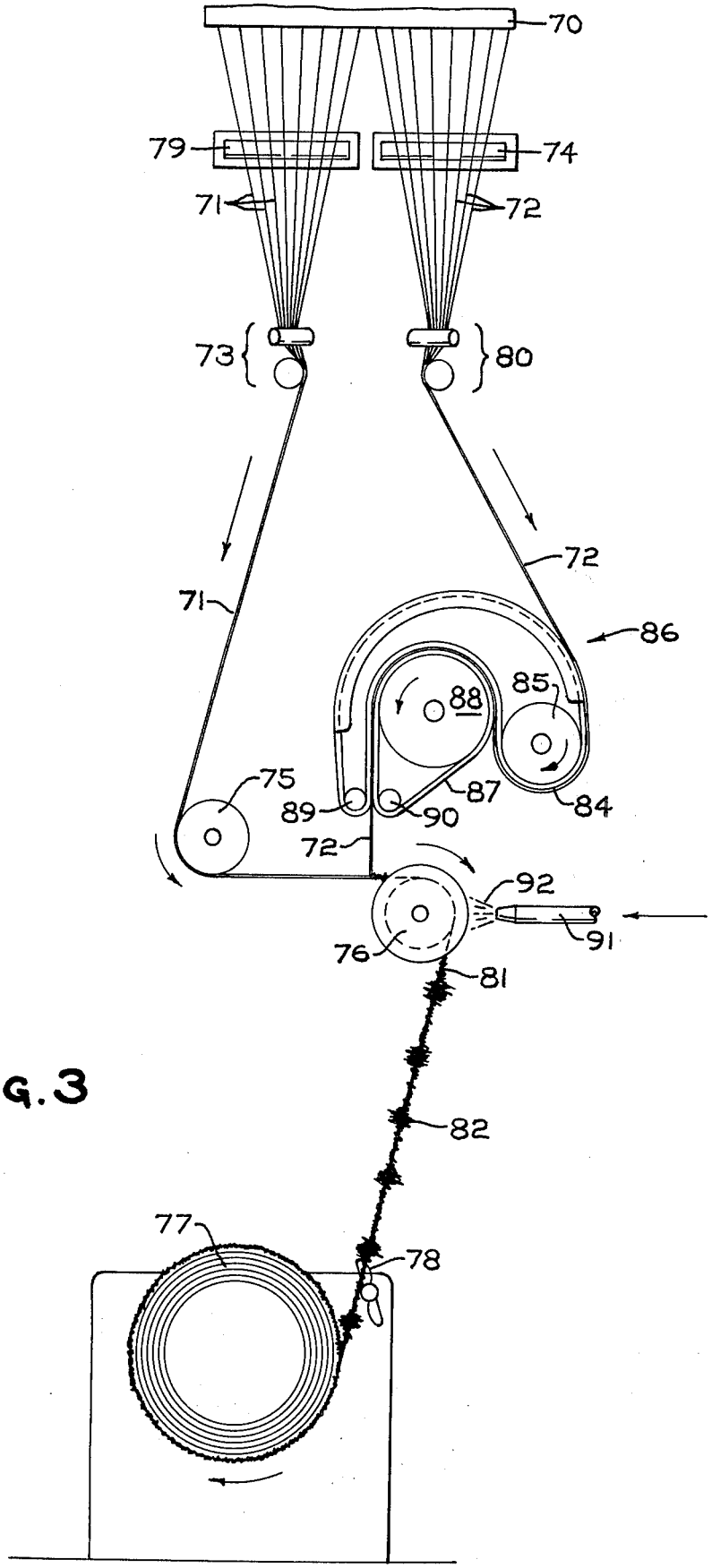
FIG. 3 shows a further alternative method of producing the slubby strand in the instant invention.

In FIG. 3 a still further embodiment of the instant invention is described in which there is shown a bushing 70 from which glass filaments are drawn and passed over applicators 74 and 79. Applicators 74 and 79 apply an aqueous binder or size to the filaments. Two fans of glass fiber strands 71 and 72 are formed by the natural grouping of the glass fiber filaments drawn from bushing 70 being wetted as they are passed over the applicators 74 and 79. These strands 71 and 72 typically contain 5 to 50 filaments per strand. The fan of strands 71 passes over a strand separating or ribboning device 73 and is drawn in a generally downward direction around a roll member 75. The strands 71 then travel in a horizontal plane to a gathering shoe member 76, typically a wheel with a central V-shaped groove. A winder 77 is provided with a spiral 78 for laying down the finished strand 81 on the package being wound by the winder 71. The fan of strands 72 passes over a strand separating or ribboning device 80 to maintain strands 72 parallel to each other and spaced apart from each other. The strands 72 are subsequently passed onto a belt member 84 which moves around idler pulley member 85 in a high speed belt attenuator generally indicated at 86. A second belt member 87 driven by the pulley 88 engages belt 84 which drives both belts and the strands 72 are thus trapped between these two belts and travel with them through the attenuator 86. The belts 84 and 87 ultimately flex back into the attenuator as they pass over pins 89 and 90, respectively. Thus the belt 84 passes around the periphery of a stationary pin member 89 and the belt 87 passes around a similar stationary pin member 90 in their travel through the attenuator 86. This flexing back of the belts ejects the strands 72 from the high speed attenuator 86 in a downward direction at high speeds. These speeds will vary with the speed of rotation of the pulleys 85 and 88.

The fibers 72 projected in this downward direction intersect the fibers 71 which are traveling in a horizontal direction, as shown in the drawing, to cause considerable entanglement of the fibers 72 with the fibers 71 prior to their consolidation into strand 81 as they pass through the gathering shoe 76. On the gathering shoe 76 the resulting entangled fibers may be sprayed with a binder 92 which is applied to the surface thereof through a suitable nozzle 91. Rotational movement of the gathering shoe 76 is slow in comparison to the rotational movement of the winder 77 causing a considerable amount of frictional drag on the entangled strands as they pass around the surface of the gathering shoe 76. This drag causes the entangled strands on the surface of strand 81 to strip back in their passage over the surface of the gathering shoe 76 and create intermittent slubs 82 along the surface of the combined strand 81. The resulting strand or yarn 81 containing the intermittent slubs 82 is then wound on the surface of the package contained on the winder 77.

It will be readily apparent to those skilled in the art that the process of the instant invention provides a slubbed yarn while glass filaments are being drawn continuously from a standard glass fiber textile bushing at the normal commercial drawings speeds of 5,000 to 15,000 feet (1524 to 4572 meters) per minute. The winder mechanisms 30, 47 and 77 described herein are normally operated to wind strands at speeds of between 5,000 to 10,000 feet (1524 to 3048 meters) per minute. Thus, the strands 11, 41 and 71 are normally drawn at speeds of 5,000 to 10,000 feet (1524 to 3048 meters) per minute while the strands 12, 42 and 72 are generally traveling at speeds of 10,000 to 15,000 feet (1524 to 4572 meters) per minute as they intersect with the strands 11, 41 and 71, respectively, during the practice of the instant invention.

Application of binders and/or sizes to the filaments drawn from fiber glass bushings is accomplished by passing the filaments over a coating surface. In the drawings a conventional belt type applicator is shown diagrammatically. These applicators generally employ a flexible endless belt which is continuously rotated through a solution of the size and/or binder to be placed on the strand. The filaments are drawn over the surace of the belt from which they pick up the binder on their surface. Typical belt type applicators shown by the prior art are those shown in U.S. Pat. Nos. 3,331,353 and 2,723,215. Roller applicators rotating through a size or binder both may also be used. A typical device of this type is shown in U.S. Pat. No. 3,848,565. Conventional spray devices may also be used if desired. In some instances water alone may be sprayed on the filaments as they are drawn from the bushing with the binder being applied on the area of the gathering shoe. In this type of operation the water imparts lubricity to the glass filaments so that they can be processed through the spreading device and gathering shoe. A spray device can be of the type shown in the drawings of the instant application.

The binders and/or sizes employed in treating glass fibers above are generally starch sizing materials, gelatin solutions, silanes, latex emulsions and other conventional textile sizes and binders. Typical of some binders and sizes employed are those described in U.S. Pat. Nos. 3,814,592, 3,814,715, 3,852,051, 3,116,192, 3,167,468 and 3,227,192. The sizes and binders used are generally aqueous solutions or emulsions of various additives.

The application of size and/or binder to the filaments or the simple application of a water spray to the filaments during forming imparts substantial water to the strands in the fans 11, 12, 41, 42 and 71, 72 shown in the drawings. Thus, these strands will typically possess a water content of 3 to 15 percent by weight basis the glass weight of the strand. Thus, for example in the embodiment of FIG. 1 the strand 11 and the strand 12 each contain a water content of between 3 to 15 percent as they collide with each other at the working surface 15. Strands 41, 42; 71 and 72 are similarly wetted at the points where they contact each other. Some moisture is lost as the strands are consolidated in the gathering shoes shown in FIGS. 1, 2 and 3 and further binder may be added to maintain a level of moisture between 3 to 15 percent in the consolidated strand as it leaves the gathering shoe.

In a typical operation of the instant invention described with particular reference to FIG. 1, the glass filaments are drawn from molten glass contained in bushing 10 and maintained therein in the molten state by appropriate electrical heating (not shown). The molten glass is normally supplied to bushing 10 from a glass melting tank generally in the manner described in U.S. Pat. No. 2,837,823. Bushing 10 may also be a marble melt type bushing in which case glass marbles are fed to the bushing and are melted therein to supply a constant source of molten glass. A typical marble melt bushing is shown in *The Manufacturing Technology of Continual Glass Fibers*, K. L. Loenstein, Elsevier Scientific Publishing Company, New York 1973 at page 102. The electrical systems used in connection with bushing temperature control are described generally in the same publication at pages 111 through pages 121.

The filaments drawn from bushing 10 are passed over the binder applicators 17 and 18 (not shown) and have a starch sizing containing a silane coupling agent applied thereto. The fan of strands 11 and 12 formed as the filaments pass over the applicator (each strand having about 50 filaments each) are passed over the strand separating or ribboning means 14. The parallel strands 11 are then passed across a curved graphite work surface 15. The parallel fibers 12 are passed to a high speed attenuator generally indicated at 16 in FIG. 1. and are trapped between the belts 19 and 23 and projected onto the surface of the working member 15 at speeds of 15,000 feet (4572 meters) per minute. The strands 11 are traveling across the surface of the workpiece 15 at a linear speed of 10,000 feet (3048 meters) per minute. Considerable entanglement of the fibers occurs at the point of impingement of the parallel strands 12 on the parallel strands 11 and the strands are then passed through the gathering shoe 32 which is constituted of a graphite wheel being notched at the center with a central groove which gathers the strands 11 and 12 together into a single strand 35. Binder spray device 34 is utilized to spray a binder 33 which consists of an aqueous starch solution on the surface of the strand 35. The rotational speed of the gathering shoe 32 produces a drag on the strand and intermittent slubs are formed on the surface of the strand and spaced from each other randomly, the maximum distance between any two slubs being approximately 12 inches and the minimum distance being approximately 4 inches. The resulting slubby strand is then would on the winder 30 which is winding the product at linear speeds of aproximately 10,000 feet (3048 meters) per minute.

The slubby strands produced are found to have a high degree of integrity and the slubs remain in place after formation.

While the invention has been described with reference to certain specific examples and illustrative embodiments, it is not intended that the invention be limited thereby except insofar as appears in the accompanying claims.

I claim:

1. The method of producing slubby glass fiber strand comprising drawing glass filaments from a molten glass source, applying an aqueous binder and/or size to the filaments, forming the filaments into two groups of glass filament strands, feeding one of said groups of glass strands at a first speed over a working surface and in parallel with each other, striking said working surface with the second of said groups of glass strands at a second speed, said strands being in parallel with each other but traveling in a direction transverse to the direction of travel of said first group of glass fiber strands, said second speed being in excess of said first speed, bending and crimping said second group of glass fiber strands on said working surface an entangling said second group of glass fiber strands with said first group of glass fiber strands upon said striking of said working surface thereby interlocking the strands of both groups and bulking the strands to produce a bulked strand, passing the bulked strand through a positive rotational gathering device to thereby form a consolidated strand of both of said groups and stripping back a portion of the surface of said consolidated strand to form intermittent slubs thereon and collecting the resulting slubby strand.

2. The method of claim 1 wherein said first group of glass fibers is traveling at speeds between 5,000 to 10,000 feet (1524 to 3048 meters) per minute and said second group, as they strike the working surface, are traveling at speeds of between 10,000 to 15,000 feet (3048 to 4572 meters) per minute.

3. A method of forming a slubby strand comprising drawing glass filaments from a molten glass source, applying an aqueous binder and/or size to the filaments as they are being drawn, forming the filaments into two groups of glass fiber strands, each strand of each group containing a multiplicity of filaments, passing one group of said glass fiber strands in parallel over a working surface at a first velocity, striking the working surface with said second group of glass fiber strands at a second velocity which is higher than said first velocity, crimping the fibers of said second group of glass fiber strands by inertial forces in said second group of strands as they strike the working surface and entangling said first and said second group of glass fiber strands as said second group of glass fiber strands strike the working surface, passing the resulting entangled strands through a gathering device to form them into a consolidated strand, applying a binder to the consolidated strand and stripping back a portion of the surface of said consolidated strand to form intermittent slubs thereon and collecting the resulting slubby strand.

4. A method of producing slubby glass strand comprising drawing glass filaments from a molten glass source, applying an aqueous binder and/or size to the filaments, forming the filaments into two groups of glass strands each containing a plurality of filaments therein, feeding the first group of glass strands in parallel at a first speed over a working surface, striking the working surface with the second group of glass strands in parallel at a second speed which is higher than the speed of travel of the first group of strands, entangling the first and the second group of strands to produce bulked strands, passing the resulting bulked strands over a gathering device to provide a single consolidated strand from said bulked strands, applying a binder thereto to maintain said bulked strands in the form of a single consolidated strand and stripping back a portion of the surface of said consolidated strand to form intermittent slubs thereon and gathering the intermittent slub containing strand on a collecting surface.

5. The method of claim 4 wherein the first group of fibers is traveling at linear speeds of 5,000 to 10,000 feet (1524 to 3048 meters) per minute and said second group of fibers is traveling at a higher speed of between 10,000 to 15,000 feet (3048 to 4572 meters) per minute.

6. The method of claim 1 wherein the strands of said groups contain water in amounts of 3 to 15 percent by weight when they contact each other at said working surface.

7. The method of claim 3 wherein the said groups of the strands contain 3 to 15 percent by weight water as they contact each other at said working surface.

8. The method of claim 4 wherein the said first and second groups of strand contain 3 to 15 percent by weight water at their point of intersection.

9. The method of claim 3 wherein the first group of fibers is traveling at linear speeds of 5,000 to 10,000 feet (1524 to 3048 meters) per minute and said second group of fibers is traveling at higher speed of between 10,000 to 15,000 feet (3048 to 4572 meters) per minute.

* * * * *

UNITED STATES PATENT OFFICE

CERTIFICATE OF CORRECTION

PATENT NO. : 3,955,952

DATED : May 11, 1976

INVENTOR(S) : Warren W. Drummond

It is certified that error appears in the above-identified patent and that said Letters Patent are hereby corrected as shown below:

Column 1, line 11 after "textile", please insert --field--.

Column 4, line 60, "71" should be --77--.

Column 5, line 56, "surace" should be --surface--.

Column 6, line 57, delete period (.) after "1".

Column 7, line 34, "an" should be --and--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*